US012145036B2

(12) United States Patent
Enes

(10) Patent No.: US 12,145,036 B2
(45) Date of Patent: Nov. 19, 2024

(54) COLLAPSIBLE ROLLING TRAVEL COVER FOR A GOLF BAG

(71) Applicant: SUN MOUNTAIN SPORTS, LLC, Missoula, MT (US)

(72) Inventor: Seth M Enes, Missoula, MT (US)

(73) Assignee: SUN MOUNTAIN SPORTS, LLC, Missoula, MT (US)

( * ) Notice: Subject to any disclaimer, the term of this patent is extended or adjusted under 35 U.S.C. 154(b) by 0 days.

(21) Appl. No.: 18/236,018

(22) Filed: Aug. 21, 2023

(65) Prior Publication Data

US 2023/0390619 A1 Dec. 7, 2023

Related U.S. Application Data

(63) Continuation of application No. 16/928,670, filed on Jul. 14, 2020, now Pat. No. 11,731,016.

(60) Provisional application No. 62/874,693, filed on Jul. 16, 2019.

(51) Int. Cl.
*A63B 55/00* (2015.01)
*A63B 55/60* (2015.01)

(52) U.S. Cl.
CPC ..... *A63B 55/404* (2015.10); *A63B 55/60* (2015.10); *A63B 2210/50* (2013.01)

(58) Field of Classification Search
CPC ..... A63B 55/404; A63B 55/60; A63B 55/30; A63B 2210/50; A63B 2209/00; A45C 7/007; A45C 7/0063; A45C 7/00; A45C 7/0018; A45C 7/0036; A45C 7/0022; A45C 7/0054
See application file for complete search history.

(56) References Cited

U.S. PATENT DOCUMENTS 3,139,164 A * 6/1964 Koffler ..... A45C 3/004 190/122
3,933,229 A * 1/1976 Pelavin ..... A45C 3/004 190/111
4,655,343 A * 4/1987 Lane ..... A45C 3/004 190/111
4,817,791 A * 4/1989 Adams ..... A47G 25/54 206/287.1
6,116,045 A * 9/2000 Hodosh ..... F25D 3/08 62/457.7
6,161,665 A * 12/2000 Hoover ..... A45C 3/00 190/125
6,374,467 B1 * 4/2002 Chen ..... A45C 7/0045 190/102
6,378,581 B1 4/2002 Sheridan
6,401,890 B1 6/2002 Tan
(Continued)

FOREIGN PATENT DOCUMENTS

CN 104757762 A 7/2015
GB 2441180 2/2008

*Primary Examiner* — Steve Clemmons
(74) *Attorney, Agent, or Firm* — Dawsey Co., LPA; David J. Dawsey

(57) ABSTRACT

A travel cover having a rigid top cap, a rigid bottom cap, and an elongated flexible enclosure extending between and bonded to said rigid top cap and said rigid bottom cap. The elongated enclosure is openable and closable to receive and retrieve contents. The travel cover has a longitudinally expanded mode for carrying contents and a collapsed mode for folding the enclosure into the rigid top cap and the rigid bottom cap to form a compact carrying case.

17 Claims, 9 Drawing Sheets

(56) References Cited

U.S. PATENT DOCUMENTS

| | | | | |
|---|---|---|---|---|
| 10,159,318 | B2 | 12/2018 | McGuire | |
| 10,856,632 | B2 * | 12/2020 | Davis | A45C 7/0095 |
| 11,388,965 | B2 | 7/2022 | McGuire | |
| 2004/0026281 | A1 | 2/2004 | Boardman | |
| 2009/0008204 | A1 | 1/2009 | Yen | |
| 2011/0083933 | A1 | 4/2011 | Engel | |
| 2013/0334081 | A1 | 12/2013 | Loudenslager | |
| 2014/0326559 | A1 | 11/2014 | Huang | |
| 2015/0216277 | A1 | 8/2015 | Boyles | |
| 2020/0163425 | A1 | 5/2020 | Dodd | |

* cited by examiner

COLLAPSIBLE ROLLING TRAVEL COVER FOR A GOLF BAG

This application is a continuation application of U.S. patent application Ser. No. 16/928,670, filed on Jul. 14, 2020, which claims priority from U.S. provisional application No. 62/874,693 by the same inventor, filed 16 Jul. 2019.

TECHNICAL FIELD

The present invention relates generally to accessories for golfers and particularly to a collapsible rolling travel covers primarily used for transporting golf bags.

BACKGROUND ART

Transporting their golf bag, most commonly via air, is a concern for golfers. There is always some trepidation regarding damage in transit. Also, golf travel covers can be awkward for the user to personally transport before and after placing the travel cover and bag enclosed therewith with a carrier such as an airline, railroad, or shipping operation.

Nonetheless, demand continues for more compact, more stable, more convenient, and lighter golf bag travel covers.

DISCLOSURE OF INVENTION

Accordingly, it is an object of the present invention to provide a collapsible travel cover for safely transporting a golf bag and equipment.

Another object of the invention is to provide golf bag travel cover which, when not in use, collapses into a compact shell.

A further object of the present invention is to provide a wheeled travel cover which is easy to pull over surfaces, such as airport terminal terrain.

Yet another object of the invention is to provide a travel cover which provides some hard shell protection to the clubs and the base of the golf bag.

Another object of the invention is to provide a unit which easily and quickly transitions between an expanded mode, suitable to contain a golf bag, clubs, and accessories, and a compact mode (empty of clubs and golf bag) about the size of a very small suitcase.

Briefly, one preferred embodiment of the present invention is a rolling travel cover having an expanded mode for transporting and protecting a golf bag and contents, and a collapsed carrying case mode. The travel cover includes a flexible enclosure which is bonded to a top cap and a bottom cap. The flexible enclosure includes a zipper or similar means of opening the enclosure to deposit and retrieve a golf bag and contents. The rear surface of the enclosure includes a backbone having series of semi-rigid plates connected by living hinges, which can accordion fold the enclosure within the top cap and bottom cap, and to reopen to form the elongated extended mode. A number of side release buckles secure the travel cover into desired configurations.

An advantage of the present invention is that it provides a convenient and compactable travel cover.

Another advantage of the invention is that the collapsed mode is bilaterally symmetrical and relatively thin such that multiple units may be stacked for storage or retail display.

A further advantage of the invention is that the top and bottom caps provide at least some hard-shelled protection to the contents when being wheeled or carried.

Yet another advantage of the present invention is that it may be easily transformed between the expanded and the compact modes.

Still another advantage of the present invention is that the backbone includes two plates which, in the compact mode, constitute the bottom surface of the carrying case.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
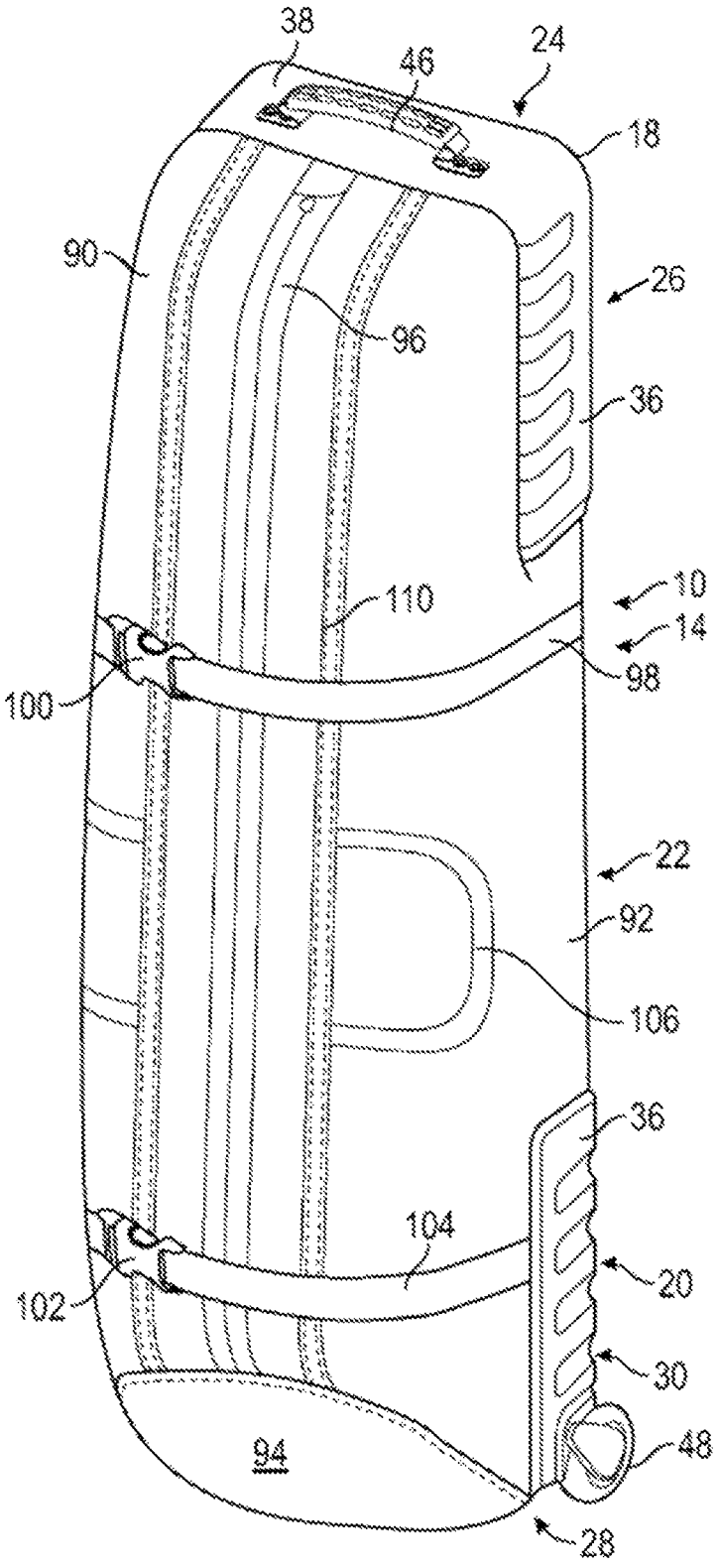
FIG. 1 is a front right perspective view of the travel cover of the present invention, in an expanded mode, with a golf bag enclosed therewithin.
Figure 2:
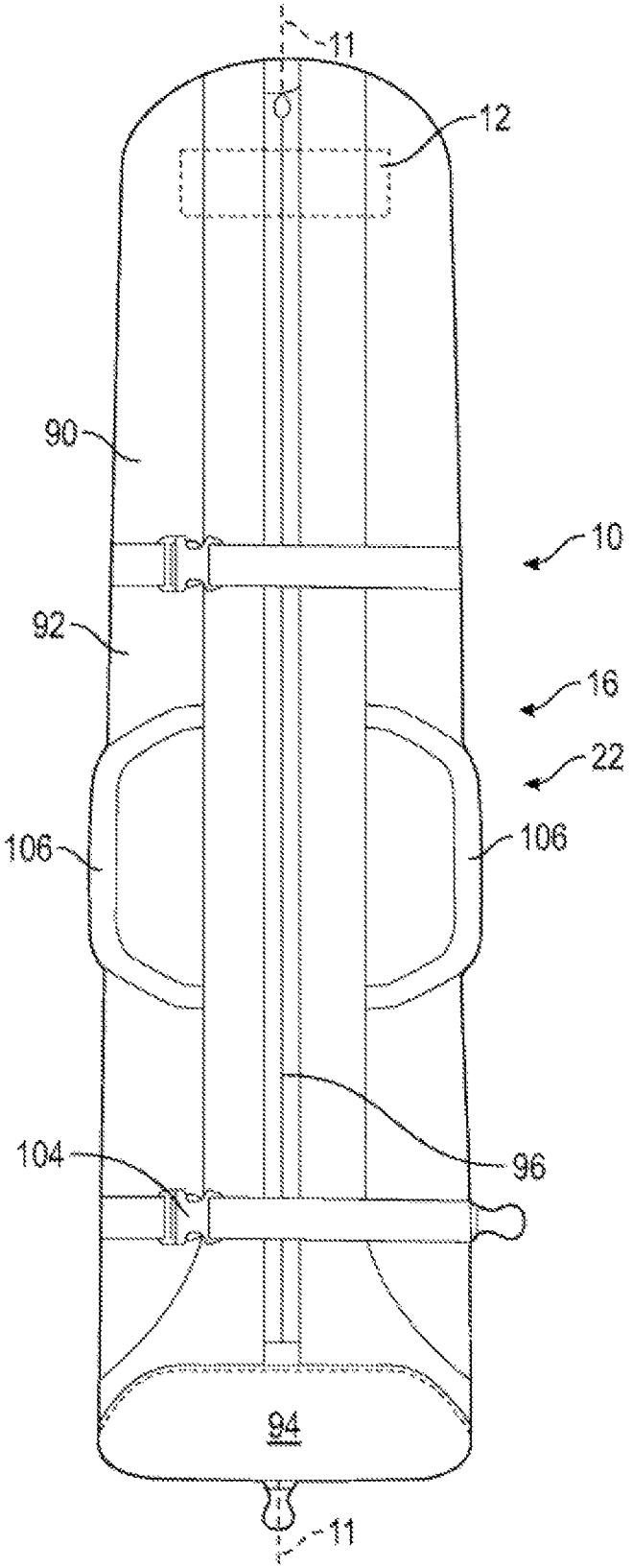
FIG. 2. is a front elevational view of the travel cover of the present invention, shown in the expanded mode with the zipper open to reveal the golf bag enclosed therein.

The present invention is a travel cover used to transport golf bags and associated golf clubs and accessories. The travel cover is referred to by the general reference character 10, and generally referred to as "travel cover 10", in the drawings and description. The travel cover 10 is generally symmetrical about a vertical (in normal operation) longitudinal plane 11. The travel cover 10 may be used with various golf bags 12 and may exist in multiple embodiments.

The travel cover 10 is used in two distinct modes. An expanded mode 14 is utilized for enclosing the golf bag 12 for safe and secure transport, and facilitating rolling along surfaces, such as parking lots and airport terminals. A collapsed mode 16 is used when the golf bag 12 is removed. This facilitates a small footprint and height in a generally cubic the form for compact storage of the travel cover 10.

The travel cover 10 includes three discrete components, a top cap 18, a bottom cap 20, and a flexible enclosure 22 bonded to and extending between the top and bottom caps (18 and 20) in the expanded mode 14. In the collapsed mode 16 the enclosure 22 is nearly completely enclosed.

In the expanded mode 14, best seen in FIGS. 1 through 5, the travel cover 10 has an upper end 24, with the enclosure 22 extending (billowed) forward, and an upper rear 26 being formed by the top cap 18. Similarly, a lower end 28 has a billowed out enclosure 22 in the front while a lower rear 30 is formed by the bottom cap 20. The enclosure 22 is bonded to the interior of the opposing caps (18 and 20) and the caps provide partial damage protection to golf bag 12 and contents.

The upper cap 18 and the bottom cap 20 are rigid or semi-rigid and are generally mirror images of each other in most respects. Each cap is integrally formed around a central panel 32 to which a portion of the enclosure 22 is bonded to the inner-facing surface. The central panel 32 has, extending vertically therefrom, a first side panel 34, a second side panel 36 and a back panel 38. The cap has an open top 40 and an open end (front) 42.

The travel cover 10 utilizes a variety of buckles for connecting and securing opposing areas. In the preferred embodiments all of the buckles are side-release-buckles (SRBs) 52. Each SRB 52 comprises a male component secured on one end of a gap with female component on the opposite end of the gap, with it being a matter of choice as to which component is on which end. The components operate as a matched unit and each matched pair will be designated as by a single callout herein.

The top cap 18 back panel 38 includes a handle 46 for carrying or towing. The bottom cap 20 includes a pair of wheels 48 at the junctures back plate 38 and the side plates (34, 36) opposite the open end 42 to facilitate rolling.

The exterior features of the top cap 18 and the bottom cap 20 also include a series of buckles. An under-handle SRB 50 extends between the back panels 38 to secure the caps together in the collapsed mode 16. Similarly the side panels (34 and 36) share, at the approximate midpoint of each, an exterior SRB 52 to further secure the travel cover 10 together in the collapsed mode 16.

Figure 3:
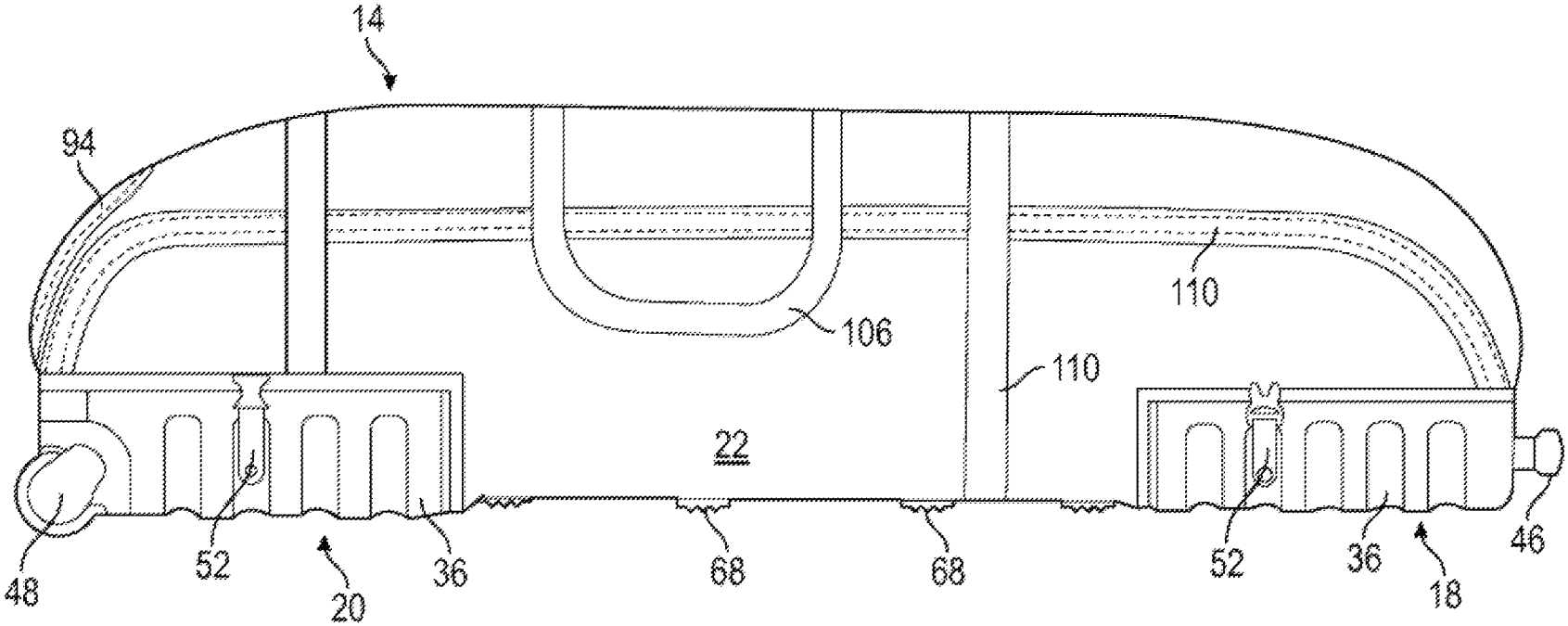
FIG. 3 is a left elevational view of the expanded travel cover of the present invention.
Figure 4:
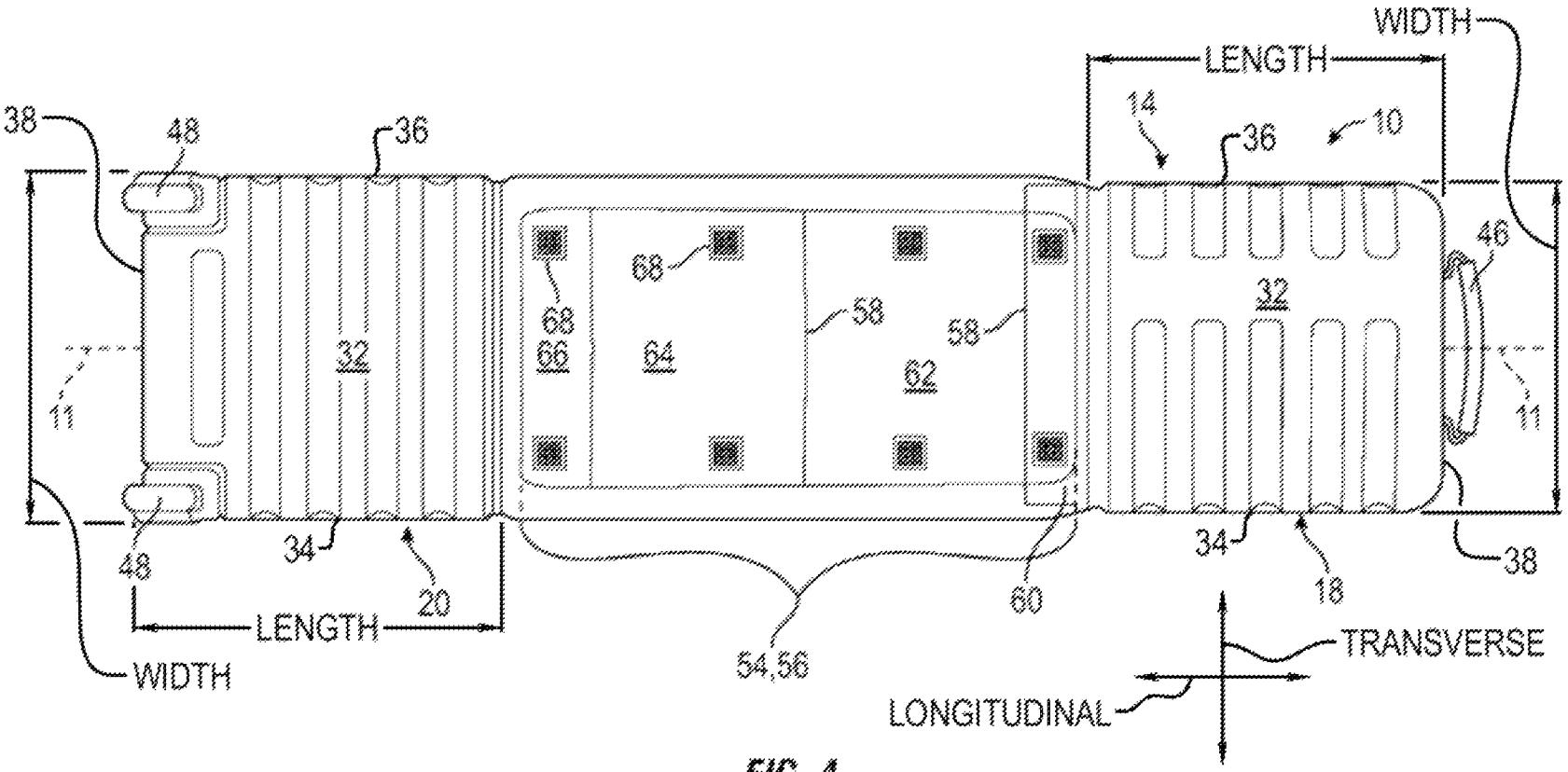
FIG. 4 is a rear elevational view of the expanded mode of the present invention.

As seen in the fanciful transitional drawings of FIGS. 5*a* through 5*d*, the travel cover 10, once the golf bag 12 and other contents are removed, collapses from the semi-bulbous elongated hump shape of the expanded mode 14, best seen in FIG. 3, to the squat, rectangular solid collapsed mode 18 seen in FIGS. 6-9.

Figure 7:
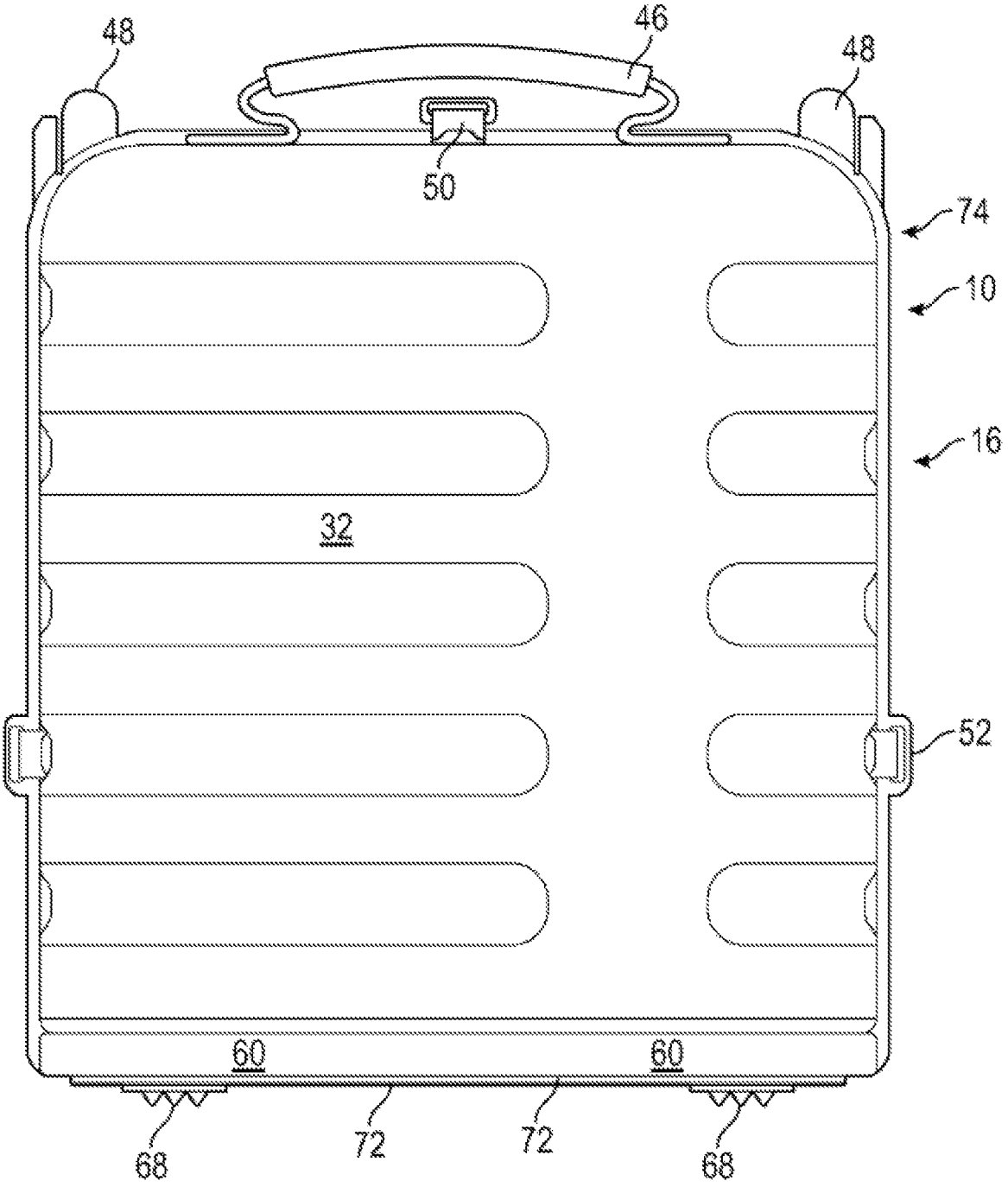
FIG. 7. is a top elevational view of the invention in collapsed mode.
Figure 8:
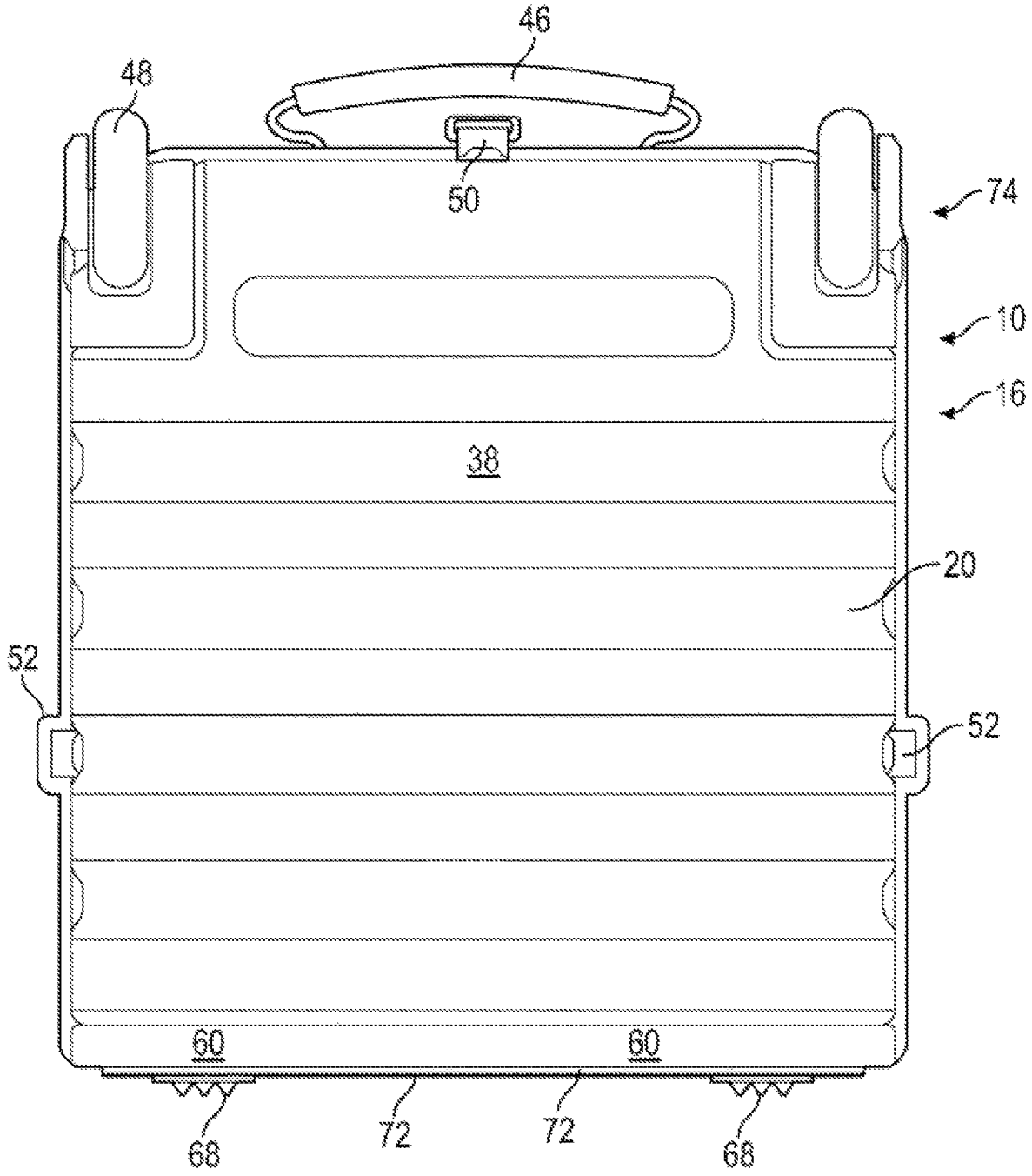
FIG. 8 is a bottom elevational view of the collapsed mode of the preferred embodiment.
Figure 9:
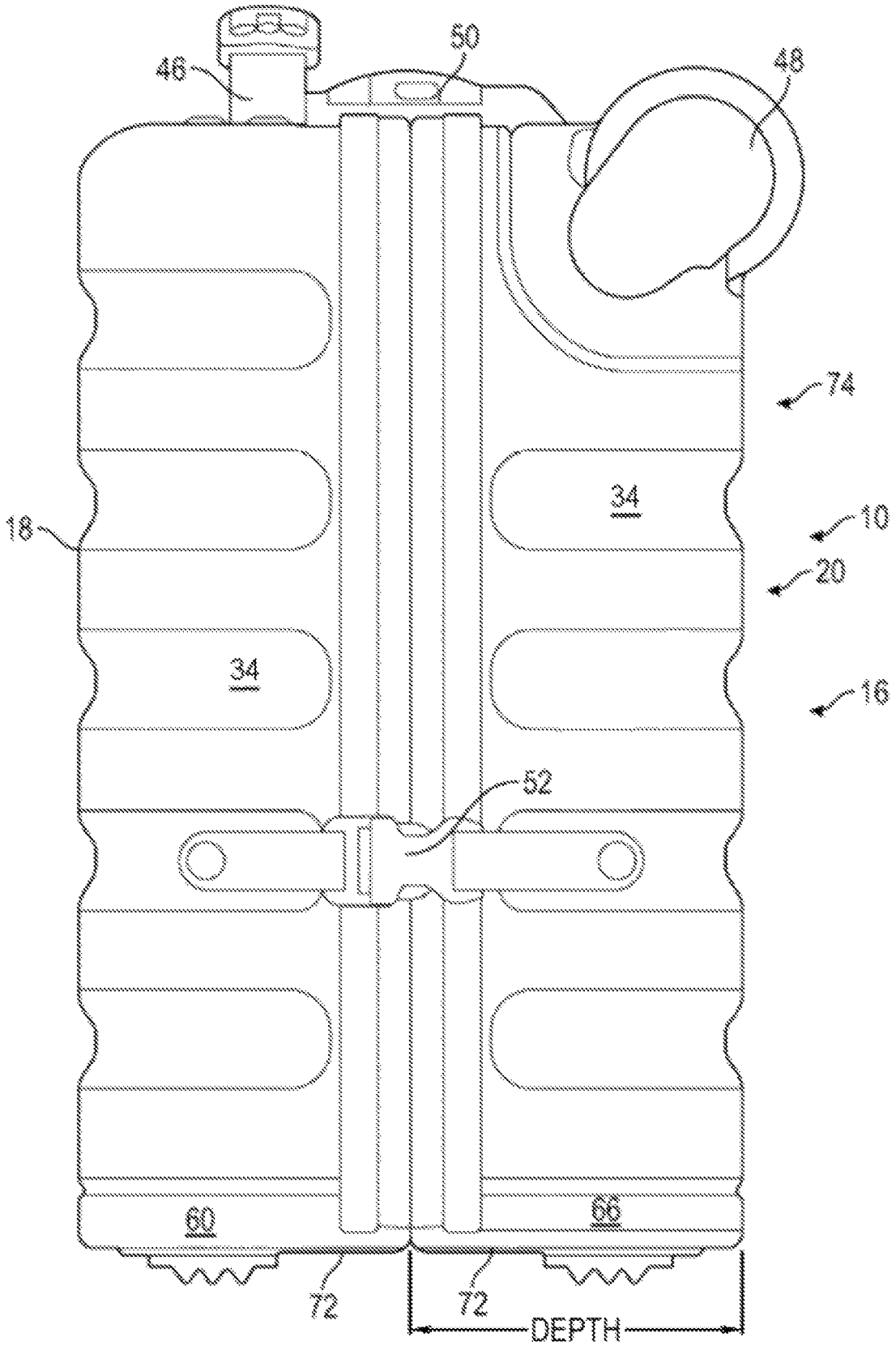
FIG. 9 is a side view of the collapsed mode of the invention.

The key components facilitating the folding efficiency of the travel cover 10 are found in a semi-rigid backbone 54 extending at the rear of the enclosure 22, which provides the interface between the caps 18 and 20 and the flexible enclosure 22. The backbone 54, best seen in FIGS. 4 and 5*b*. includes a series of typically fabric-covered semi rigid rectangular plates 56, joined by living hinges 58. From top to bottom (see FIG. 4) the rectangular plates 56 include: a top cap end plate 60; a first interior plate 62, a second interior plate 64; and a bottom cap end plate 66. Each of the rectangular plates includes on its exterior surface a spaced apart pair of bumpers 68. The bumpers 68 cushion the surfaces when the expanded mode 14 is laid down (FIG. 3) while bumpers 68 on the top and bottom end plates 60 and 66 provide both cushioning and sliding resistance in the collapsed mode 16 (FIGS. 7-9).

The top cap end plate 60 is secured to the central panel 32 at the open end 42 of the top cap 16 by a living hinge 58, while the bottom cap plate 66 is similarly connected by a living hinge 58 to the central panel 32 open end 42 of the bottom cap 20.

In the transition operation the top cap end plate 60 and the bottom cap end plate 66 each respectively fold inward on the respective living hinge 58 to abut with the first and second side panels (34 and 36) of the respective top and bottom caps (18 and 20) to complete a box half 70 for each cap (16 and 18). For this reason, the top and bottom plates (60 and 66) extend laterally further than the interior plates (62 and 64) so they are stopped against the side plates (34 and 36), rather than rotating further into the respective box half 70. Then the first and second interior plates (62 and 64), which are formed to be longitudinally about double the length of the end plates (60 and 66) to form the central components of the backbone 54 of the flexible enclosure 22 respectively accordion fold into the respective box half 70, pulling and squeezing the flexible enclosure 22 until the edges of the top cap 18 and bottom cap 20 abut against each other with almost the entirety of the flexible enclosure 22 (excluding a base 72 formed by the top and bottom plates 60 and 66), being contained inside a complete carrying case 74 formed by the box halves 70 once the under-handle and exterior SRBs (52 and 54) are engaged in the collapsed mode 16.

Figure 5A:
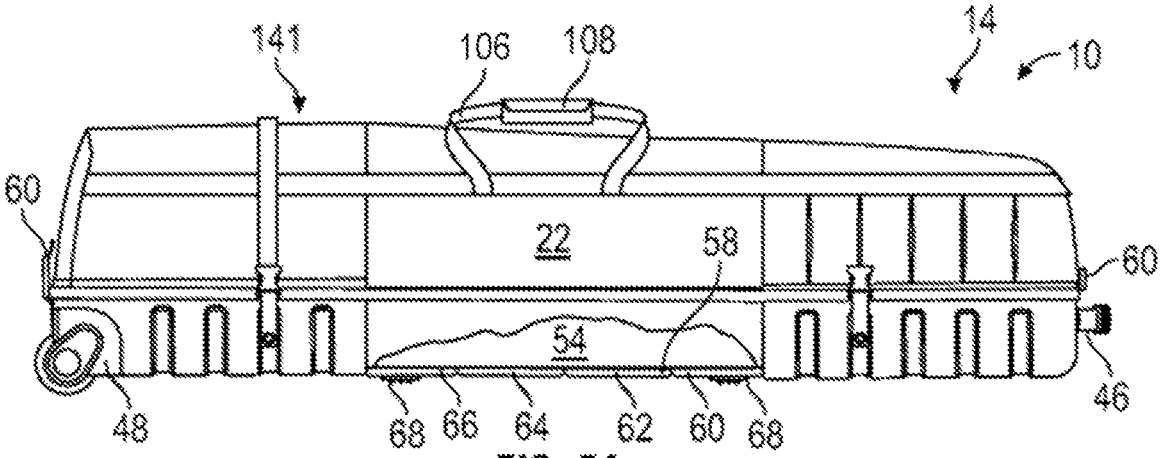
FIG. 5*a* through FIG. 5*d* illustrate the transitional steps of expanding and collapsing the invention.
Figure 5B:
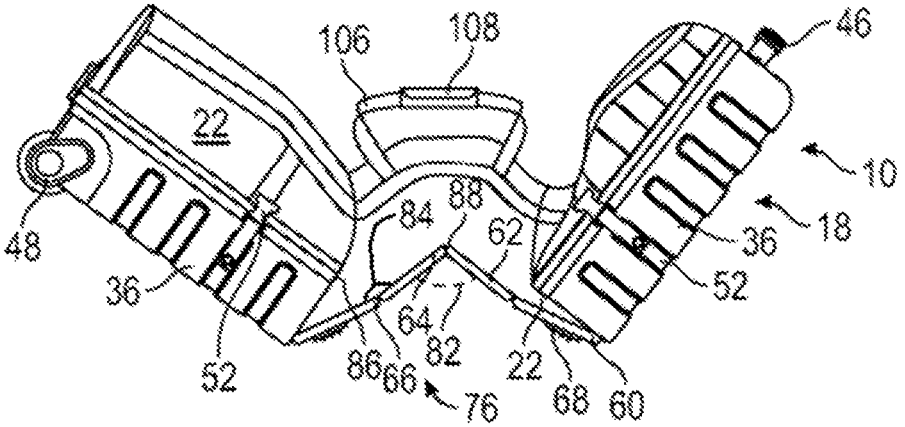
Figure 5C:
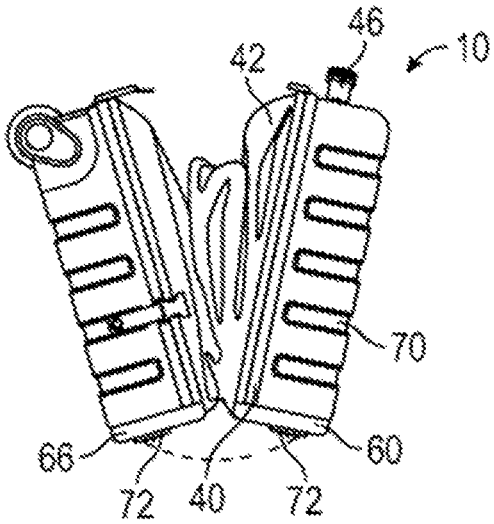
Figure 5D:
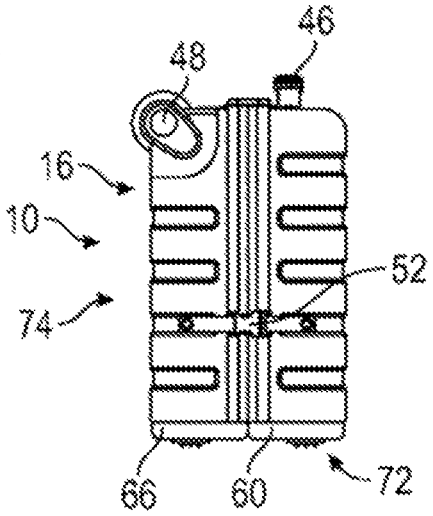
Figure 6:
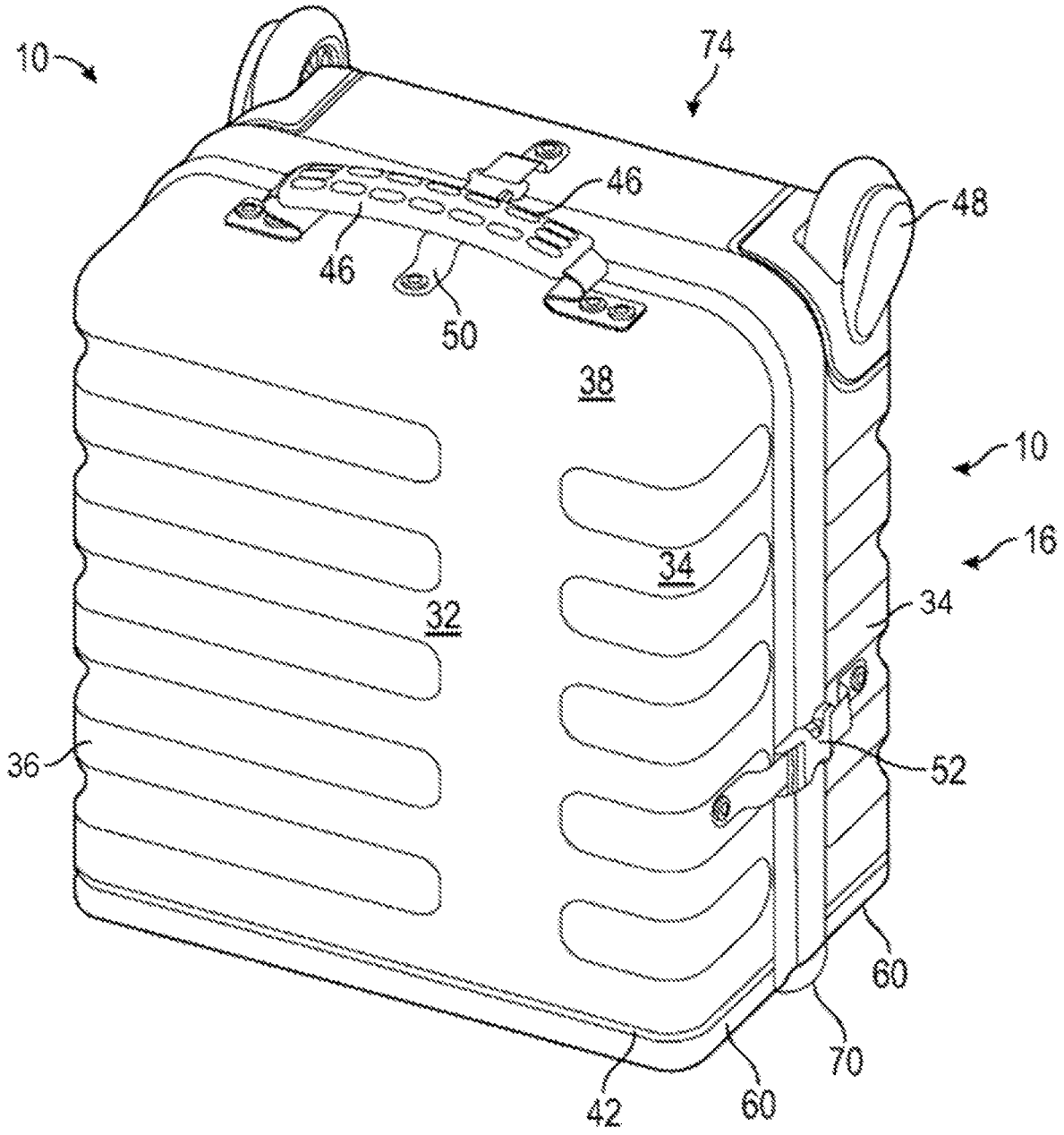
FIG. 6. is a top/front perspective view of the travel cover of the present invention, shown in the collapsed mode.

The illustrations of FIGS. 5*a* through 5*d* show the transition between the expanded mode 14 and the collapsed mode 16 and vice versa. FIG. 5*a* (similar to FIG. 4) shows the fully expanded mode 14 while FIG. 5*d* shows the collapsed mode 16. Intermediate conditions are shown in FIGS. 5*b* and 5*c*, with FIG. 5*b* showing the accordion folding patterns of the backbone 54 with particular attention to the relevant series of interior angles 76. An interior angle between the top end plate 60 and the top cap 18 and is limited to ninety degrees of rotation from the flat position of FIG. 5*a* and the abutment with the top cap 18. An interior angle between the top end plate 60 and the first interior plate 62, and can be an obtuse angle ranging to an extremely acute angle as the first interior plate 62 accordion folds into the top box half 70. Angle C 82 is the interior angle between the first and second interior plates 62 and 64 which becomes increasingly acute as the accordion folding proceeds. Angle D 84 is the interior angle between the second interior plate 64 and the bottom end plate 66, and Angle E 86 is the interior angle between the bottom end plate 66 and the bottom cap 20. As the accordion folding transition proceeds the top and bottom caps 18 and 20 will, as shown in FIG. 5*c*, either be drawn together or forced apart depending on the direction of the transition.

In the expanded mode 14 the flexible portions of the enclosure 22 are primarily in the form of a heavy canvas shroud 88. A hood 90 portion extends over the upper end 24, a tunnel 92 portion forms the intermediate extent, and a reinforced foot 94 portion extends down to the bottom cap 20. A zipper 96 (or other securing element) runs from the top of the hood 90 to near the foot 94. The zipper 96 facilitates access to the interior of the enclosure 22 to allow insertion and removal of the golf bag, shoes, clubs, and other accessories.

The exterior of the enclosure 22 features a first circumferential strap 98 with a first SRB 100 and a second circumferential strap 102 with a second SRB 104 to further hold the shroud 88 together and minimize slack. A pair of mid-tunnel carrying straps 106 with a snap sleeve 108 facilitate carrying or supporting the travel cover 10 from near the center of mass. In the preferred embodiment shown in the drawings reinforcing stitching 110 extends to either side of the zipper 96 to secure the carrying straps 106 and provide visible enhancement.

The top and bottom caps 18 and 20 are either high strength molded plastic or molded aluminum while the shroud 88 is high grade canvas. The buckles are high grade plastic. The wheels/casters 48 may be durable plastic or rubberized aluminum.

Many modifications to the above embodiment may be made without altering the nature of the invention. The dimensions and shapes of the components and the construction materials may be modified for particular circumstances or types of bags to be carried.

While various embodiments have been described above, it should be understood that they have been presented by way of example only, and not as limitations.

INDUSTRIAL APPLICABILITY

The travel cover 10 of the present invention is intended for use primarily by golfers (or other travelers with similarly elongated cargo) who desire to transport equipment with optimal convenience, content protection, and safety. The travel cover 10 is relatively lightweight and is suitable for carrying or rolling. The rigid top and bottom caps 18 and 20 provide damage protection from the most likely directions.

For typical use, the travel cover 10 will be stored in the collapsed mode 16 when not in use for transport. When it is time to pack up the golf bag 12 and related equipment, the user transitions the travel cover 10 to the expanded mode 14, as described above. The buckles on the carrying case 74 are released and the enclosure 22 is unfolded and stretched out. The zipper 96 is opened to insert the contents and then closed when all is ready. The first and second straps and SRBs (98, 100, 102, and 104) are engaged and tightened and the carrying straps 106 are engaged if desired. The travel cover 10 is then suited for rolling or carrying transport and delivery to luggage handling. Upon reaching the destination the reverse transition is accomplished and the compact carrying case 74 is suited for storage.

The extreme convenience, ease of operation, relative compactness, and light weight of the inventive travel cover 10 make it a joy to own and use and a desirable accessory for any golfer who wishes to travel with a protected container for precious golf equipment which can withstand baggage handling. The collapsed mode 16 also provides a highly compact storage and transport carrying case 74.

For the above, and other, reasons, it is expected that the travel cover 10 of the present invention will have widespread industrial applicability. Therefore, it is expected that the commercial utility of the present invention will be extensive and long lasting.

What is claimed is:

1. A travel cover, comprising:

a top cap having a top cap central panel extending (a) transversely from a top cap dextral side panel to a top cap sinistral side panel and defining a top cap width, and (b) longitudinally from a top cap back panel and defining a top cap length, wherein:

the top cap dextral side panel and the top cap sinistral side panel extend a top cap depth distance from the top cap central panel;

the top cap back panel extends from the top cap sinistral side panel to the top cap dextral side panel;

a top cap closed end is created by the top cap back panel, the top cap sinistral side panel, the top cap dextral side panel, and the top cap central panel;

a bottom cap having a bottom cap central panel extending (a) transversely from a bottom cap dextral side panel to a bottom cap sinistral side panel and defining a bottom cap width, and (b) longitudinally from a bottom cap back panel and defining a bottom cap length, wherein:

the bottom cap dextral side panel and the bottom cap sinistral side panel extend a bottom cap depth distance from the bottom cap central panel;

the bottom cap back panel extends from the bottom cap sinistral side panel to the bottom cap dextral side panel;

a bottom cap closed end is created by the bottom cap back panel, the bottom cap sinistral side panel, the bottom cap dextral side panel, and the bottom cap central panel;

an elongated flexible enclosure extending between and attached to said top cap and said bottom cap, said elongated enclosure being openable and closable to receiving and retrieving contents, wherein:

said travel cover has a longitudinally expanded mode for carrying contents and a collapsed mode for folding portions of said enclosure into said top cap and said bottom cap to form a compact carrying case;

in the longitudinally expanded mode the top cap back panel and the bottom cap back panel are on opposite ends of the travel cover;

in the collapsed mode the top cap back panel and the bottom cap back panel are located on a common end of the compact carrying case; and a rear side of the flexible enclosure further includes at least one end plate, which in the expanded mode is parallel to the top cap central panel and the bottom cap central panel, and folds in the collapsed mode to be perpendicular to the top cap central panel and the bottom cap central panel and form at least a portion of a base.

2. The travel cover of claim 1, wherein the at least one end plate includes a top end plate and a bottom end plate, which in the expanded mode are parallel to the top cap central panel and the bottom cap central panel, and fold in the collapsed mode to be perpendicular to the top cap central panel and the bottom cap central panel and form the base.

3. The travel cover of claim 2, wherein the rear side of the flexible enclosure further includes at least one interior plate located between the top end plate and the bottom end plate, which in the expanded mode is parallel to the top cap central panel and the bottom cap central panel, and in the collapsed mode is located internally between the top cap and the bottom cap.

4. The travel cover of claim 3, wherein the at least one interior plate includes a first interior plate and a second interior plate, which in the expanded mode are parallel to the top cap central panel and the bottom cap central panel, and in the collapsed mode are located internally between the top cap and the bottom cap.

5. The travel cover of claim 1, wherein the base includes at least one external bumper.

6. The travel cover of claim 1, further including a bottom circumferential strap attached to the bottom cap dextral side panel and the bottom cap sinistral side panel, wherein the bottom circumferential strap includes at least one buckle.

7. The travel cover of claim 1, further including at least one bottom cap buckle attached to the bottom cap, and at least one top cap buckle attached to the top cap, wherein the at least one top cap buckle cooperates with the at least one bottom cap buckle to secure the top cap to the bottom cap in the collapsed mode.

8. The travel cover of claim 7, wherein the at least one bottom cap buckle includes a bottom cap back panel buckle attached to the bottom cap back panel, the at least one top cap buckle includes a top cap back panel buckle attached to the top cap back panel, and the bottom cap back panel buckle cooperates with the top cap back panel buckle to secure the top cap to the bottom cap in the collapsed mode.

9. The travel cover of claim 8, further including a handle attached to the top cap back panel, and the top cap back panel buckle passes between the handle and the top cap back panel.

10. The travel cover of claim 8, further including a plurality of wheels attached to the bottom cap.

11. The travel cover of claim 8, wherein the at least one bottom cap buckle includes a bottom cap side panel buckle attached to the bottom cap dextral side panel, the at least one top cap buckle includes a top cap side panel buckle attached to the top cap dextral side panel, and the bottom cap side panel buckle cooperates with the top cap side panel buckle to secure the top cap to the bottom cap in the collapsed mode.

12. The travel cover of claim 1, wherein the top cap length is greater than the top cap width, and the bottom cap length is greater than the bottom cap width.

13. The travel cover of claim 1, wherein the top cap length is equal to the bottom top cap length.

14. The travel cover of claim 13, wherein the top cap width is equal to the bottom top cap width.

15. The travel cover of claim 1, wherein the top cap dextral side panel is parallel to the top cap sinistral side panel, the bottom cap dextral side panel is parallel to the bottom cap sinistral side panel, the top cap dextral side panel is parallel to bottom cap dextral side panel, the top cap dextral side panel and the top cap sinistral side panel are perpendicular to the top cap central panel, and the bottom cap dextral side panel and the bottom cap sinistral side panel are perpendicular to the bottom cap central panel.

16. The travel cover of claim 1, wherein the top cap is a single-piece molded plastic component, and the bottom cap is a single-piece molded plastic component.

17. The travel cover of claim 1, wherein the top cap is a single-piece aluminum component, and the bottom cap is a single-piece aluminum component.

* * * * *